US005243748A

United States Patent [19]

Morello

[11] Patent Number: 5,243,748

[45] Date of Patent: Sep. 14, 1993

[54] CRIMPER APPARATUS AND METHOD

[75] Inventor: Frederick Morello, Johnston, Pa.

[73] Assignee: M.I.C. Industries, Inc., Reston, Va.

[21] Appl. No.: 906,498

[22] Filed: Jun. 30, 1992

[51] Int. Cl.[5] ..... B23P 11/00

[52] U.S. Cl. ..... 29/243.5

[58] Field of Search ..... 29/243.5, 243.57, 243.58; 72/210, 248; 269/253

[56] References Cited

U.S. PATENT DOCUMENTS

| | | | |
|---|---|---|---|
| 3,875,642 | 4/1975 | Knudson . | |
| 3,902,288 | 9/1975 | Knudson . | |
| 3,967,430 | 7/1976 | Knudson . | |
| 4,364,253 | 12/1982 | Knudson . | |
| 4,470,186 | 9/1984 | Knudson | 29/243.5 |
| 4,505,084 | 3/1985 | Knudson . | |
| 4,583,724 | 4/1986 | Huang | 269/253 |
| 4,726,107 | 2/1988 | Knudson . | |

*Primary Examiner*—Robert C. Watson

*Attorney, Agent, or Firm*—Rothwell, Figg, Ernst & Kurz

[57] ABSTRACT

An apparatus for crimping the adjacent side edges of two panels includes a base with first and second crimping members. One of the crimping members is fixed to the base while the other is threaded on a screw member secured to the base. The screw member is rotated by a motor to drive the crimping members together. The apparatus is placed on adjacent panels of the type having preformed mating side edges. The side edge of one panel is in the form of an inverted channel in which the side edge of the other panel fits. The apparatus crimps the side edges so that a downturned leg of the channel is folded onto a portion of the other panel's side edge, thereby crimping the panels together so that a rotary seaming apparatus can be applied to provide a permanent watertight connection. The apparatus is provided with a non-abrasive material to prevent scratching or marring of the panel surfaces.

19 Claims, 7 Drawing Sheets

CRIMPER APPARATUS AND METHOD

BACKGROUND OF THE INVENTION

1. Field of the Invention

The invention relates to a device and method for sufficiently seaming together the edge portions of adjacent panels so that a rotary seaming device can be applied to the panels to provide a continuous connecting seam.

2. Prior Art and Backround

It is known to construct continuous arch metal buildings with adjacent curved building panels which are seamed together at their adjacent edges. See for example U.S. Pat. No. 3,902,288 (1975) owned by MIC Industries, Inc.

In connection with seaming of panels for such metal buildings rotary seamer devices have been used. See for example the seaming devices disclosed in U.S. Pat. Nos. 3,875,642 (1975) and 4,470,186 (1984) and 4,726,107 (1988).

The seamers seam adjacent panel side edge portions together and hold them together. As to the panels, each panel comprises a main portion from which the side edge portion extends vertically. The first panel includes an outturned side edge portion having an upwardly extending outwardly turned flange portion and a downturned terminal portion, forming an inverted U-shaped channel. In other words, a first section extends upwardly from the panel, a second section extends outward laterally from the first section, and a third section extends downward from the second section to form the U-shaped channel. The second panel includes an inturned side edge portion having an inwardly turned flange portion disposed inside the U-shaped channel of the first panel. This inturned side edge portion has a first section extending upwardly from the panel and a second section extending laterally inward from the first section; these sections respectively fit in the first and second sections of the first panel. See, e.g. the following patents owned by MIC Industries, Inc. 3,967,430 (1976) and 4,505,084 (1984).

As stated above, the downturned terminal portion of the one panel must be bent under toward the inturned portion of the other panel before the rotary seamer can effectively travel along the panels and forms the continuous final seam. This has led to the use of manual devices to bend the downturned terminal portion so that rotary seamers can be applied to form the final seam.

Such manual crimping devices utilize a lever-type action to bend this downturned portion to a position which permits application of a rotary seamer to the panels. An inherent problem with such devices is that their effectiveness is limited by the amount of power which can be applied by the user. This in turn is limited to the mechanical advantage provided by the device. The use of metal panels having increased strength and thickness in modern structures adds to the difficulty in using such lever-type devices. This can lead to inadequate crimping as well as worker fatigue and inefficiency since these manual devices must be used every time a new panel is started.

Furthermore, additional tabs, or edge portions, are often seamed in the building panels to support various structures such as roofing panels, lighting fixtures, ventilation ducts or the like. This can add to thickness of the edge portions which must be folded before a rotary seaming device can be applied.

Another problem arising from the use of these manual crimping devices is undesirable scratching or marring of the surfaces of the panels being seamed together. The use of these manual lever-type, or scissor-type devices can often damage the panel surfaces when applied to the side edge portions.

SUMMARY OF THE INVENTION

This invention provides a novel crimping device for starting seams between adjacent building panels so that a rotary seam forming device can be applied to the panels.

This invention also provides a crimping device which overcomes the problems of the devices currently used to start seams between building panels. The device of the present invention utilizes a rotatable screw member which drives a first crimping member towards a second crimping member to bend the downturned terminal portion of the side edge of one panel under the edge porion of the other panel.

The present invention further provides a crimping device that will not scratch or damage the surface of the building panels on which it is being applied.

The present invention additionally provides a novel method of bending the terminal edge portion of one panel under the edge portion of an adjacent panel to start a seam between the panels.

DETAILED DESCRIPTION OF THE PREFERRED EMBODIMENT

Figure 1:
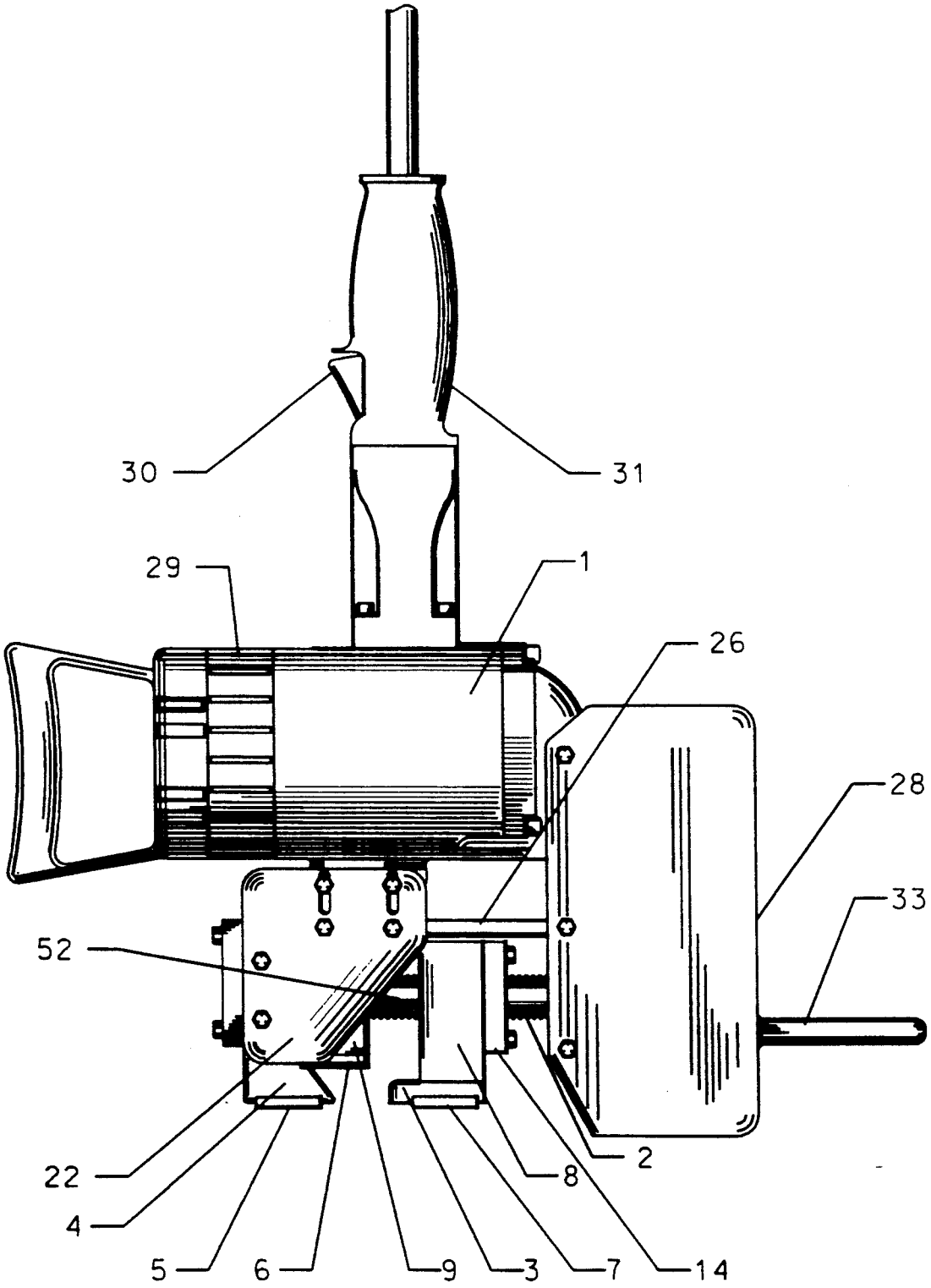
FIG. 1 is a side view of a crimping device embodying features of the present invention.

Referring now to FIGS. 1–5, there is shown a self-powered device for crimping together edge portions of adjacent building panels so that a rotary seam forming apparatus can be applied. The device includes a rotatable screw member 2 driven by an electric motor 1. The motor 1 is secured to a mounting plate 24 which is adjustably attached to a bracket 18. This feature allows the motor 1 and mounting plate 24 to be movable with respect to the remaining portion of the device, as will be discussed below.

The motor also has a mounting bracket 25 secured to it which bolts to a bracket 22 in an adjustable fashion. This bracket 22 is secured to a main mounting plate 26, which forms a base, and to a rear bearing block 9. The motor 1, mounting plate 24 and bracket 25 are adjustable relative to the main mounting plate 26 and the bracket 18. The main mounting plate 26 and the bracket 18 support the screw member 2 and the first and second crimping members 3 and 4.

Figure 5:
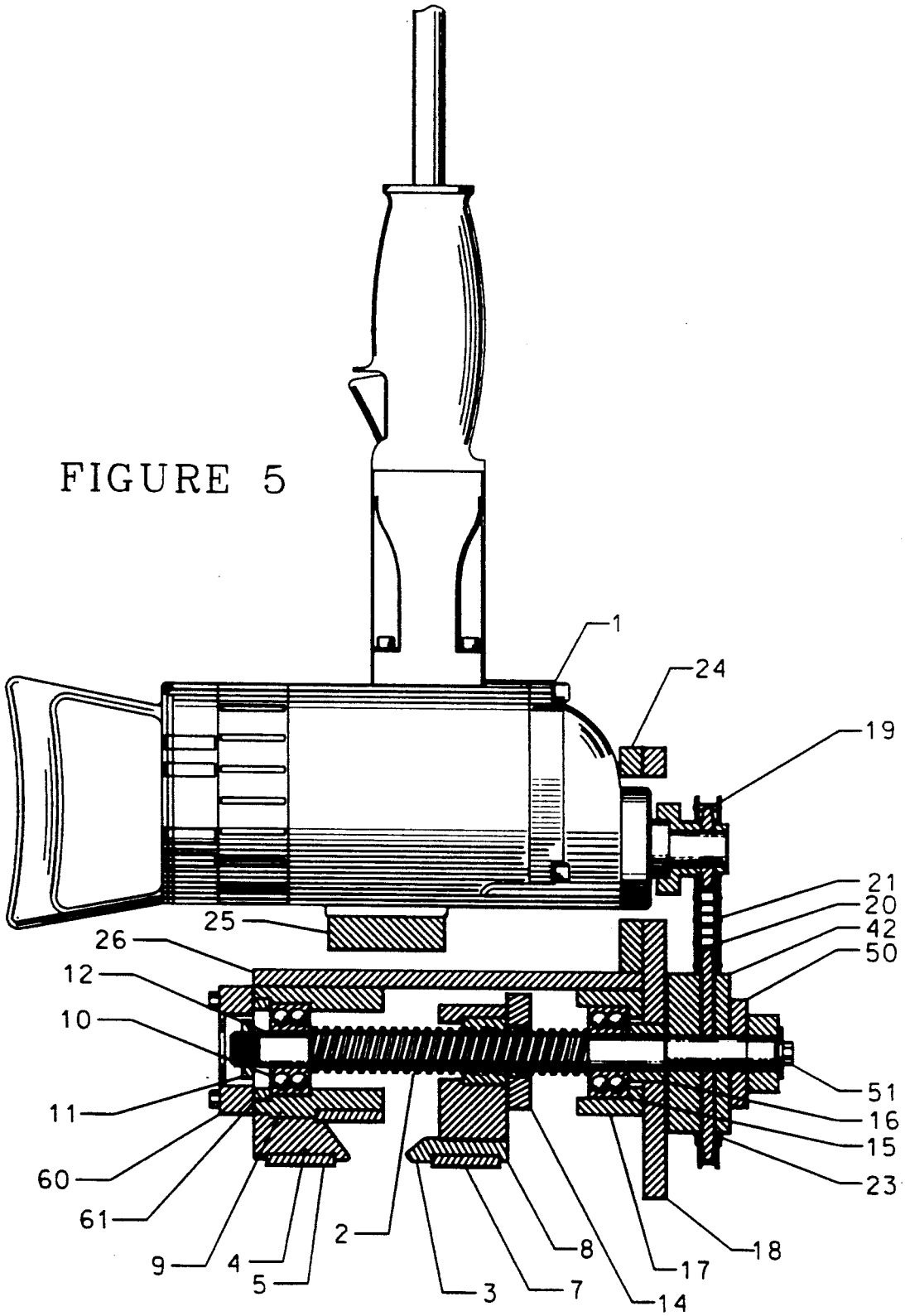
FIG. 5 is a cross sectional view of the device depicted in FIGS. 1–4.

Referring to FIG. 5, screw member 2 is secured at one end to a bracket 18 and is journalled at that end in a bearing member 15 disposed in a front bearing block 17. A clutch assembly 42 is disposed on the side of bracket 18 opposite the side on which the front bearing block 17 is disposed, and will be discussed below. A spacer 16 is captured between the clutch assembly 42 and the inner race of bearing 15 and cooperates with the bearing block 17 and bracket 18 to secure the components together. The other end of screw member 2 is journalled in a bearing 10 disposed in a rear bearing block 9. A spacer 12 and a lock nut 11 cooperate with a shoulder formed in the block 9 to secure these components together. Both front bearing block 17 and rear bearing block 9 are secured to main mounting plate 26 and rotatably support screw member 2. Guide rods 52 bolted together by blocks 9 and 17 further support the device.

The driving of the screw member by the motor will now be described. The motor is capable of rotating the screw member 2 in a forward and a reverse direction so as to move the crimping member 3 both into and out of engagement with the panel. Collar 29 serves to reverse the direction of the motor to withdraw the crimping member 3 from the panels. The motor 1 has attached at one end a sprocket assembly 19 which engages a roller chain 21. The roller chain 21 engages a sprocket 20 which is captured between two clutch plates 23 forming part of an automatic clutch assembly 42. The clutch plates 23 drive the clutch assembly 42 which is firmly secured to screw member 2. When sufficient force is applied to these clutch plates by large adjusting nut 50, rotation of sprocket 19 by motor 1 rotates roller chain 21, which in turn rotates sprocket 20 captured between clutch plates 23. The clutch assembly 42 is thus rotated and drives the screw member 2. As a safety feature, this automatic clutch assembly 42 allows the motor 1 to spin freely when the first crimping member 3 reaches its fully engaged or fully retracted position, as discussed below. This prevents damage to the motor and components of the device during operation.

As stated previously, the motor 1 is movable relative to bracket 18 and the screw member 2. This permits any necessary adjustment of the tension in roller chain 21 simply by shifting the motor 1, since this will shift sprocket assembly 19 which engages the chain 21. Moreover, this allows any necessary replacement of the motor 1 by removing bracket 25 and mounting plate 24 from bracket 22 and bracket 18, respectively.

Figure 6:
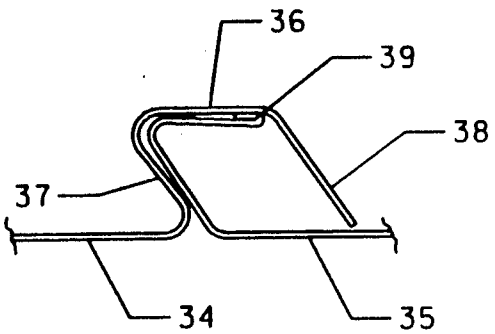
FIGS. 6 and 7 show cross sectional views of one type of building panels suitable for application of the present invention, with the downturned terminal portion unbent and bent, respectively.

A first crimping member 3, which is configured to engage and bend the downturned terminal edge portion of the one panel, panel 34 in FIG. 6, is secured to a block 8 which has a bronze thread portion 13 bolted to it. The thread portion 13 is threaded to a flange 14 and surrounds the screw member 2. When the motor 1 rotates the screw member 2, the block 8, thread portion 13, flange 14 and first crimping member 3 all move linearly to the left as viewed in FIGS. 1–5. The guide rods 52 prevent rotation of first crimping member 3 and block 8 as they move along screw members.

A second crimping member 4 is bolted to the rear bearing block 9 and is configured to engage the upwardly extending edge portion 37 of panel 34 opposite the terminal edge 38 engaged by crimping member 3. The crimping member 4 is fixed relative to the screw member 2, and the first crimping member 3 moves toward crimping member 4 to bend the terminal edge 38 of panel 34 under the edge 39 of panel 35.

The first crimping member 3 is provided with glide member 7 and the second crimping member 4 is provided with glide members 5 and 6. These glide members are bolted to the crimping members and contact the surface of the panels when the device is disposed in its operating position to protect the surface from scratching, marring or any like damage. The glide members are made of a friction-free, abrasion resistant material such as ultra high molecular weight (UHMW) polyethylene, but any material which will not damage the surface of the panels is effective.

The operation of the crimping device of the present invention will now be described. FIGS. 6–13 illustrate examples of the type of building panels to which the present invention can be applied, though its application to other types of panels not specifically set forth will be readily recognized.

Figure 7:
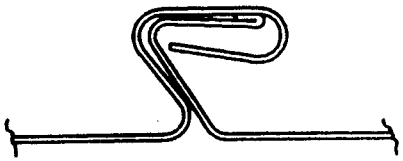

The panels shown in FIGS. 6–9 are commonly used to form arched roof sections of building structures as is known in the art and shown by U.S. Pat. Nos. 3,902,288 (1975) and 4,364,253 (1982). FIGS. 6 and 7 show a first panel 34 with an outturned side edge portion having an upwardly extending outwardly turned flange portion and a downturned terminal portion 38, forming an inverted U-shaped channel. In other words, a first section 37 extends upwardly from the panel, a second section 36 extends outward laterally from the first section 37, and a third section 38 extends downward from the second section 36 to form the U-shaped channel.

The second panel 35 includes an inturned side edge with a hem portion 39 disposed inside the U-shaped channel of the first panel. This inturned side edge portion has a first section extending upwardly from the panel and a second section extending laterally from the first section; these sections respectively fit in the first and second sections of the first panel, as shown in FIG. 7.

Figure 2:
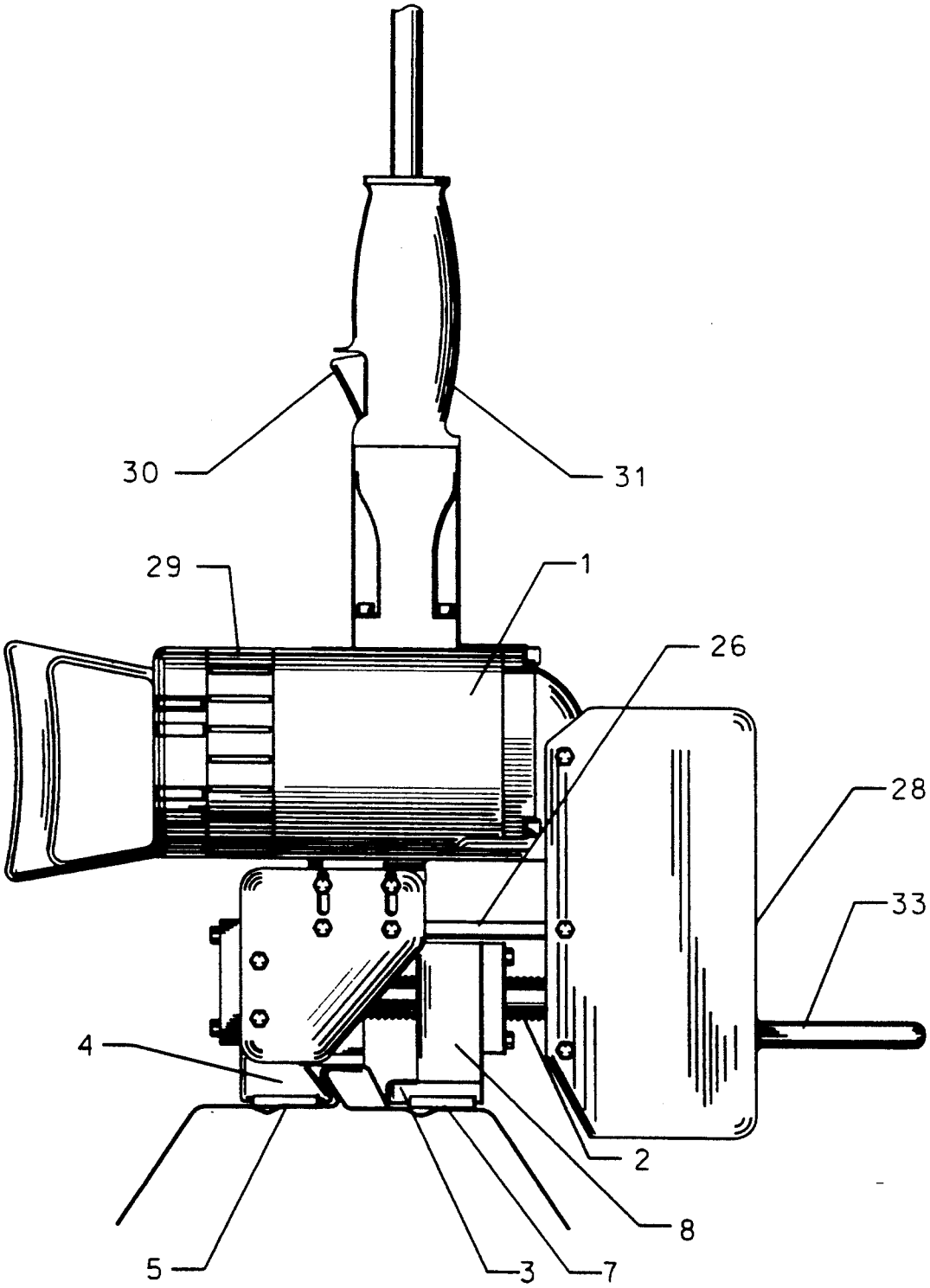
FIG. 2 is a side view of the crimping device of the present invention mounted on adjacent panels before being operated.
Figure 3:
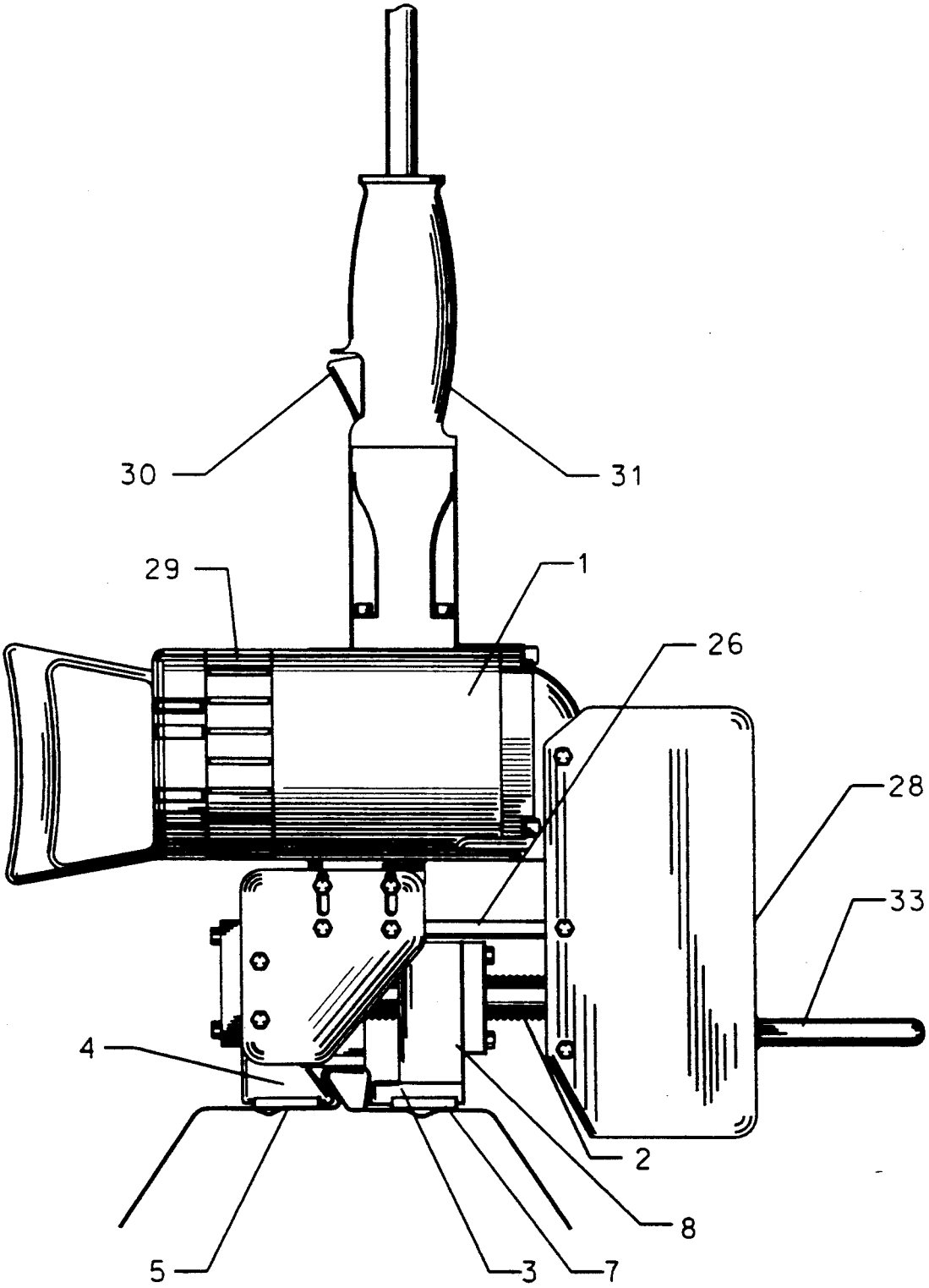
FIG. 3 is a side view similar to FIG. 2 but with the device in operation and one of the crimping members being moved to bend the downturned terminal edge portion of one panel.
Figure 4:
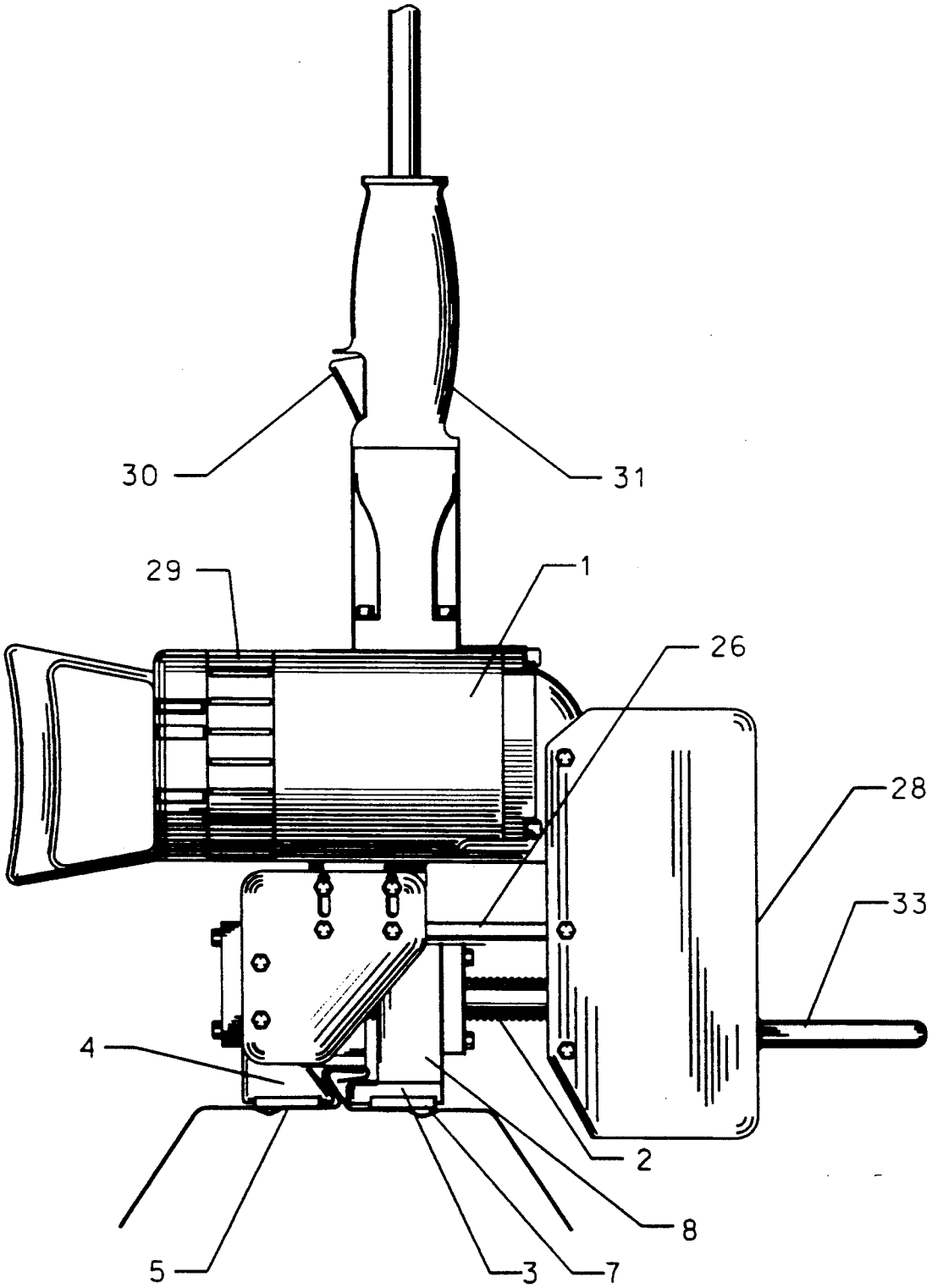
FIG. 4 is a side view of the device with the crimping member moved to its maximum bending position.

FIG. 2 shows the crimping device of the present invention in place on adjacent panels 34 and 35. Crimping member 3 is disposed on panel 35 and is adjacent the downturned terminal edge of panel 34. Crimping member 4 is disposed on panel 34 and is adjacent the upwardly extending outwardly turned flange portion of panel 34. FIG. 6 shows the panels 34 and 35 without the crimping device engaging the edge portions of the panels. FIG. 3 shows the device with crimping member 3 moved one-half through its crimping motion. As shown, the downturned terminal edge portion is bent under by the crimping member 3. FIG. 4 shows the crimping member 3 in the complete forward position at the end of its crimping motion with the downturned terminal edge portion 38 completely turned under the edge portion 39 of panel 35.

Figure 8:
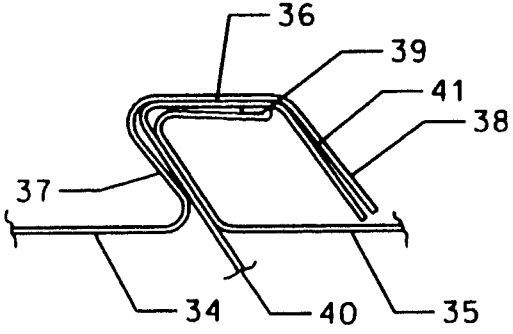
FIGS. 8 and 9 show cross sectional views of the type of panels in FIGS. 6 and 7 but with a tab portion of an additional member disposed therebetween.
Figure 9:
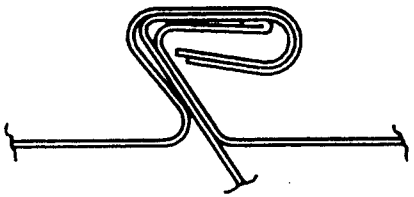

FIGS. 8 and 9 show building panels similar to those depicted in FIGS. 6 and 7 but having the tab or edge portion 41 of an additional panel 40 disposed there between. This edge portion 41, which extends from ceiling panels, lighting fixtures, or the like as discussed above, must also be crimped to allow application of a rotary seaming device. The crimping member 3 of the present invention easily bends this portion 41 along with the downturned terminal portion 38 of panel 34 under the edge of panel 35, as shown in FIG. 9.

Figure 12:
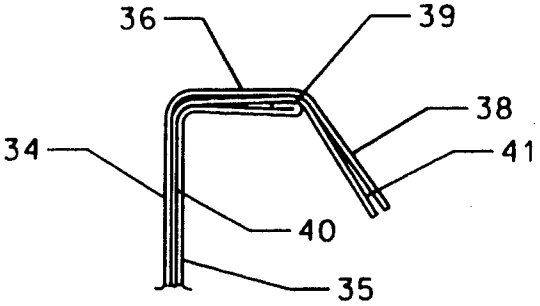
FIGS. 12 and 13 show cross sectional views of the type of panels in FIGS. 10 and 11 but with a tab portion of an additional member disposed therebetween.
Figure 13:
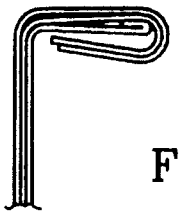
Figure 10:
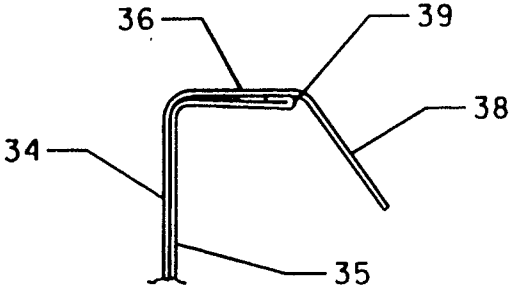
FIGS. 10 and 11 show cross sectional views similar to FIGS. 6 and 7 but of another type of panels suitable for application of the present invention.
Figure 11:
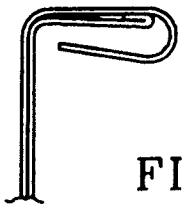

FIGS. 10–13 show panels commonly used for straight roof sections but which can also be used for those of the arched type. The operation of the crimping device of the present invention on this type of panel is essentially the same as on the panels of FIGS. 6–9. The crimping member 3 engages downturned terminal edge portion 38 of panel 34 and bends it under the edge portion 39 of the other panel 35. This allows application of a rotary seaming device to finish the connection by forming a continuous watertight seam. FIGS. 12 and 13 show the panels of FIGS. 10 and 11 with the tab or edge portion 41 of an additional member 40 disposed therebetween, similar to FIGS. 8 and 9.

Several safety features are provided on the crimping device of the present invention. Handles 31, 32 and 33 allow easy manipulation of the device during use. A trigger mechanism 30 is disposed on handle 31 to actuate the motor 1 to operate the device. The motor also includes a reversing feature in the form of a collar 29, as stated above. A cover 28 encloses moving sprockets 19 and 20, moving chain 21, and rotating clutch assembly 42 to provide added safety during operation.

Although the present invention has been described with a certain degree of particularity, it should be understood this disclosure has been made by way of example and that changes in details of structure may be made without departing from the spirit thereof.

I claim:

1. An apparatus for crimping together adjacent edge portions of two panel members so that a rotary seamer can be placed on the crimped edge portions of the panels and the seamer can be used to form a continuous final seam connecting said two panel members along the length thereof, the apparatus comprising:

a base;

a motor secured to said base;

a screw member rotatably secured to the base and driven by said motor;

a first crimping member threadedly attached to the screw member so as to be laterally movable thereon and having means for engaging a downturned terminal edge portion of one of said two panel members;

a second crimping member fixed to said base and having means for engaging an upwardly extending edge portion of said one panel member, said upwardly extending edge portion being opposite said downturned terminal edge portion;

whereby upon rotation of said screw member in a first direction by said motor, said first crimping member is driven towards said second crimping member to bend said downturned terminal edge portion of said one panel member toward said upwardly extending edge portion of said one panel member, and said downturned terminal edge portion is bent under said edge portion of the other panel member to allow a rotary seaming apparatus to be placed thereon and run along the length of the panel members to form a continuous final seam.

2. The apparatus of claim 1 wherein the engaging means of said first and second crimping members have means for engaging respective surfaces of said two panel members in a non-abrasive manner to prevent scratching of the surfaces.

3. The apparatus of claim 1 wherein said motor is operable to rotate said screw member in a direction opposite said first direction to move said first crimping member away from said second crimping member so that the apparatus can be moved along said two panel members.

4. The apparatus of claim 1 wherein said motor has a first sprocket assembly which engages a chain member, and the chain member engages a second sprocket assembly attached to said screw member for rotating said screw member.

5. The apparatus of claim 4 wherein said motor can be moved relative to said screw member to allow adjustment of tension in said chain member.

6. The apparatus of claim 4 wherein said second sprocket assembly includes a clutch assembly which allows said motor to rotate without rotating said screw member when said first crimping member reaches a predetermined position.

7. The apparatus of claim 5 or 6 wherein said first and second crimping members have means to engage respective surfaces of said two panel members in a non-abrasive manner to prevent scratching of the surfaces.

8. The apparatus of claim 1 wherein the engaging means of said first and second crimping members are capable of crimping together the edge portions of said two panel members when a tab portion of a third panel member is disposed between said edge portions of said two panel members.

9. An apparatus for initially crimping together two adjacent panels so that a rotary seaming apparatus can be subsequently used to seam the panels together, each panel with a flat portion and a side edge portion, wherein the side edge portion of one panel has a first section extending upwardly from the flat portion, a second section extending laterally from the first section away from the flat portion, and a third section extending downwardly from the second section to form an inverted channel, and wherein the side edge portion of the other panel has a first section extending upwardly from the flat portion and a second section extending laterally from the first section toward the flat portion, and wherein said first and second sections of said other panel side edge portion are disposed within said channel respectively abutting the first and second sections of said one panel side edge portion, said apparatus comprising:

a base with a screw member secured thereto;

a motor for rotating said screw member;

first crimping means for engaging said downwardly extending third section of said one panel side edge portion;

second crimping means, secured to said base, for engaging said first and second sections of said one panel side edge portion; and means for moving said first crimping means along said screw member toward said second crimping means in response to rotation of said screw member so that said first crimping means folds the third section of said one panel side edge portion over the second section of said other panel side edge portion to crimp a portion of the panels to allow a rotary seaming apparatus to be subsequently used to form the seam joining said two panels together.

10. The apparatus of claim 9 wherein said first and second crimping members are provided with means for engaging said panel members in a non-abrasive manner to prevent scratching of said panel members when the device is disposed on the panel members.

11. The apparatus of claim 10 wherein said means for engaging the panel surfaces in a non-abrasive manner includes a member formed of an abrasion resistant material secured to each of said crimping members.

12. The apparatus of claim 2 wherein said means for engaging the panel surfaces in a non-abrasive manner includes a member formed of an abrasion resistant material secured to each of said crimping members.

13. The apparatus of claim 7 wherein said means for engaging the panel surfaces in a non-abrasive manner includes a member formed of an abrasion resistant material secured to each of said crimping members.

14. A crimper apparatus for initially crimping together the edges of two adjacent panels along a portion of the length thereof so that a rotary seaming device can be subsequently run along the length of the panels to form a continuous final seam, wherein one panel edge includes an first upward edge portion and a second downturned terminal edge portion and the edge of the other panel is received between the first and second edge portions of the one panel, the crimper apparatus comprising:

a base with a motor secured thereto;

a screw member secured to the base and being rotatably driven by the motor;

a fixed crimping member configured to engage the first upward edge portion of the one panel; and a movable crimping member attached to the screw so as to be movable along the screw upon rotation thereof, the movable crimping member being configured to engage the second downturned terminal edge portion of the one panel member;

whereby upon rotation of the screw member the movable crimping member moves toward the fixed crimping member to bend the second downturned terminal edge portion of the one panel towards the first upward edge portion of the one panel and over the edge of the other panel, thus crimping the panels together along a portion of the length thereof to allow the placement of a rotary seaming apparatus on the crimped edges of the panels.

15. An apparatus for crimping together adjacent edge portions of two panel members, the apparatus comprising:

a base;

a motor secured to the base;

a screw member rotatably secured to the base and driven by said motor;

a first crimping member threadedly attached to the screw member so as to be laterally movable thereon and having means for engaging a downturned terminal edge portion of one of said two panel members;

a second crimping member fixed to said base and having means for engaging an upwardly extending edge portion of said one panel member, said upwardly extending edge portion being opposite said downturned terminal edge portion; and wherein said motor has a first sprocket assembly which engages a chain member, and the chain member engages a second sprocket assembly attached to said screw member for rotating said screw member;

whereby upon rotation of said screw member in a first direction by said motor, said first crimping member is driven towards said second crimping member to bend said downturned terminal edge portion of said one panel member toward said upwardly extending edge portion of said one panel member, and said downturned terminal edge portion is bent under said edge portion of the other panel member.

16. The apparatus of claim 15 wherein said motor can be moved relative to said screw member to allow adjustment of tension in said chain member.

17. The apparatus of claim 15 wherein said second sprocket assembly includes a clutch assembly which allows said motor to rotate without rotating said screw member when said first crimping member reaches a predetermined position.

18. The apparatus of claim 16 or 17 wherein said first and second crimping members have glide members to engage respective surfaces of said two panel members in a non-abrasive manner to prevent scratching of the surfaces.

19. An apparatus for crimping together adjacent edge portions of two panel members, the apparatus comprising:

a base;

a motor secured to the base;

a screw member rotably secured to the base and driven by said motor;

a first crimping member threadedly attached to the screw member so as to be laterally movable thereon and having means for engaging a downturned terminal edge portion of one of said two panel members;

a second crimping member fixed to said base and having means for engaging an upwardly extending edge portion of said one panel member, said upwardly extending edge portion being opposite said downturned terminal edge portion; and wherein the engaging means of said first and second crimping members are capable of crimping together the edge portions of said two panel members when a tab portion of a third panel member is disposed between said edge portions of said two panel members;

whereby upon rotation of said screw member in a first direction by said motor, said first crimping member is driven towards said second crimping member to bend said downturned terminal edge portion of said one panel member toward said upwardly extending edge portion of said one panel member, and said downturned terminal edge portion is bent under said edge portion of the other panel member.

* * * * *